United States Patent [19]

Garnett

[11] Patent Number: 4,962,827

[45] Date of Patent: Oct. 16, 1990

[54] EXTENDABLE, ELEVATABLE, ROTATABLE, COLLAPSIBLE BOOM AND BASKET FOR VEHICLES

[76] Inventor: Edward V. Garnett, 9152 Kahuliu Dr., Huntington Beach, Calif. 92646

[21] Appl. No.: 381,771

[22] Filed: Jul. 18, 1989

[51] Int. Cl.[5] ..... B66F 11/04

[52] U.S. Cl. ..... 182/2; 182/223

[58] Field of Search ..... 182/2, 223; 212/266

[56] References Cited

U.S. PATENT DOCUMENTS

| | | | |
|---|---|---|---|
| 2,938,594 | 5/1960 | Eitel | 182/2 |
| 3,005,512 | 10/1961 | Vogan | 182/2 |
| 3,056,510 | 10/1962 | Garnett | 182/2 |
| 3,258,084 | 6/1966 | Robb | 182/2 |
| 3,472,337 | 10/1969 | Atchey | 182/2 |
| 3,842,933 | 10/1974 | Clark | 182/2 |

*Primary Examiner*—Reinaldo P. Machado

*Attorney, Agent, or Firm*—Horace B. Van Valkenburgh

[57] ABSTRACT

An extendable, elevatable and rotatable boom carrying at its outer end a basket which is longitudinally collapsible in order to reduce the longitudinal space occupied by the collapsible basket, the boom and basket being adapted to be mounted on a rescue crash or service vehicle having a cab. The collapsible basket may be stored behind the cab with the boom in storage position behind the basket and both the boom and basket when stored, extending upwardly no further than the cab. The cab, with the basket positioned above at least a part of the cab, may have means providing access between the cab and basket, such as a sliding panel of the top of the cab and pivotal front and rear bottom plates of the basket. The rear end of the boom is pivoted on an upper base assembly, in turn pivoted on a lower base assembly, so that when an extendable, preferably multi-stage cylinder pivotally connected to the boom at a point adjacent its inner end, moves the boom upwardly, the front end of the upper base assembly will pivot on the front end of the lower base assembly, as until the upper base assembly is directly above the lower base assembly. A releasable locking mechanism secures the upper base assembly in this position, with further extension of the boom lift cylinder merely increasing the angularity of the boom to the horizontal. The outer half of a turntable is attached to support beams, while the lower base assembly is mounted on the inner half of the turntable. The outer end of the outer cylinder of the boom, when in storage, may be raised by an arm and roller assembly to a position in which the collapsed basket may be unfolded to a position over the cab. The basket may have a front and back connected by sides, each having a hand rail at the top and pivotally connected to the outside of the front and back as well as pivoted about a vertical axis at the center to permit the sides to be folded between the fronts and back after the floor plates are pivoted upwardly.

19 Claims, 9 Drawing Sheets

EXTENDABLE, ELEVATABLE, ROTATABLE, COLLAPSIBLE BOOM AND BASKET FOR VEHICLES

This invention relates to an extendable, elevatable, rotatable and collapsible boom particularly adapted to carry a collapsible basket and adapted to be mounted on a vehicle. Such a vehicle may be a self-propelled crash, rescue, fire control, or service vehicle. It is not only desirable as an air crash-rescue vehicle, in that it can be stored in a transport plane for conveyance to a desired site, but it is also useful as a land vehicle for fire control in cities and rural areas and other service uses, as at airports. The extendable boom carries a basket which may be occupied by one or more persons, while the boom should be extendable to reach an appreciable height and length. For transport by air, the dimensions of length, width and height are limited. To achieve the desired dimensions for air transport, the boom and its associated structure should not only be retractable for storage in a limited space, but the basket should also be collapsible and storable in a comparable limited space. The vehicle should have as low a center of gravity as possible, to facilitate driving over rough and steep terrain, such as to reach a crash site from an available landing place for the plane as close as possible to the crash site, as well as to provide greater safety in negotiating sharp turns and maneuvering on city or rural streets and roads. It is also desirable for the above purpose to have a low boom height to permit the installation of a light weight rescue ladder or chute mounted on top of the boom without exceeding the overall low heights required for entry into fire department doors.

The Edward V. Garnett U.S. Pat. No. 3,056,510, issued Oct. 2, 1962, for Derrick For Vehicles, discloses a derrick having an extendable boom adapted to be mounted on a support just rearwardly of the cab of a vehicle, while a pivotal bracket lever which provides a pivotal support for the boom, may be swung upwardly to elevate the pivot point of the boom or back down to decrease the height at which the boom is stored over the cab. The boom may also carry a cage or basket which is vertically collapsible so that, in storage position, it will occupy less vertical space, although it does occupy a greater horizontal space when collapsed for storage at the rear of the vehicle, over the boom and above the panel body. The end of the boom is also provided with a pulley for a hoisting cable. The vehicle on which the derrick is mounted is provided with a jack leg or outrigger on each side at the location of the boom support. The vehicle is shown as truck-like, with a cab and a panel body, while in storage position, the base of the boom extends over the cab.

Among the objects of this invention are to provide a novel boom and basket which may be placed in a low storage position on a vehicle, such as a self-propelled, rescue, crash or service vehicle; to provide such a boom and basket which permits the vehicle to be transported by air; to provide such a boom which is rotatable, extendable and elevatable on a vehicle; to provide a collapsible basket which may be mounted on the end of the boom and which may be collapsed for placement in a storage position in which it is essentially not higher than the boom in storage position; to provide such a basket which, in collapsed position, reduces the length of the vehicle on which mounted; to provide such a boom which may be placed in a storage position with the upward extension of the boom not appreciable greater than the upward extension of the cab of a vehicle; to provide such a boom having a collapsible basket for accommodating one or more persons and mounted on the outer end of said boom; to provide such a basket which may be stored behind the cab with a height not appreciably greater than the cab; to provide such a basket which is collapsible horizontally for storage behind the cab; to provide such a basket which may be positioned over the cab for entry by one or more persons from the cab; to provide such a basket mounted on the boom with provision to permit a person to enter the basket from the cab when the basket is positioned with only a portion of the bottom of the basket over the cab; to provide a vehicle with a cab having a roof in which an opening may be provided to permit a person to move from the cab into the basket while the vehicle is travelling; to provide such a basket, the folding for storage and unfolding for use of which may be controlled from the cab; to provide such a boom and basket which produces a relatively low center of gravity of a self-propelled vehicle on which installed, so as to enhance the ability of the vehicle to traverse rough and steep terrain as well as city or rural streets and roads; and to provide such a vehicle, boom and basket which are readily constructed and will be effective and efficient in operation.

Additional objects and the novel features of this invention will become apparent from the description which follows, taken in connection with the accompanying drawings, in which.

DETAILED DESCRIPTION OF THE INVENTION

Figure 1:
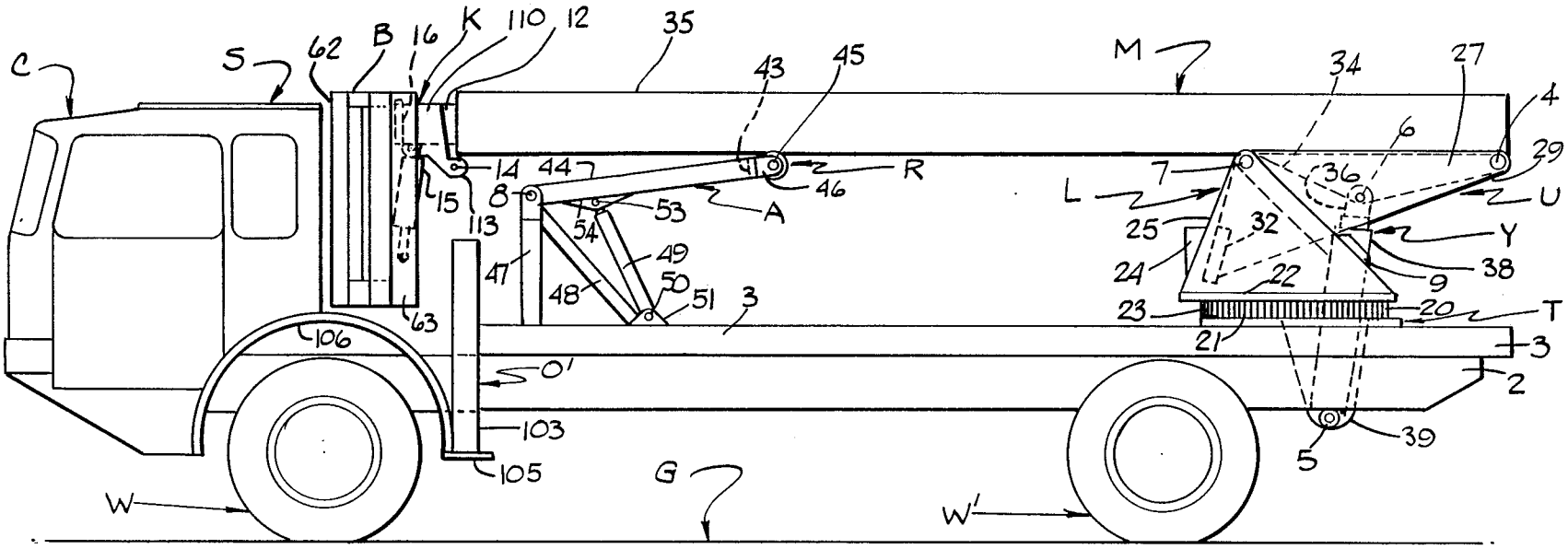
FIG. 1 is a side elevation of the operating parts for and a boom and basket of this invention, in storage position on a vehicle.

A boom M and basket B of this invention, as in FIG. 1, may be mounted on a vehicle V having a front cab C, with an extendable boom M being stored in retracted position behind the top of the cab. An upper base assembly U for the boom is shown in retracted position on a lower base assembly L, in turn mounted on a turntable T at the rear of the vehicle, with the retracted boom M in a position parallel to a beam 2 of the frame of the vehicle and a beam 3 of a sub-frame for the boom and parts associated therewith, extending longitudinally of the vehicle frame. The inner end of the boom is pivotally connected by a pivot pin 4 to an upper base assembly U, while an extendable cylinder Y, preferably having multiple stages, is pivotally anchored on a pivot pin 5 below the frame and also pivotally connected to the underside of the boom by a pivot pin 6. A lower base assembly L is mounted on a turntable T and pivotally supports upper base assembly U by a pivot pin 7. An arm assembly A is mounted on a special frame supported by beams 3 and is pivoted on a pin 8 at each side. Arm assembly A carries a roller R and moves it into engagement with the underside of the boom for raising the outer end of the boom for a purpose described below. The upper base assembly U, when pivoted to the retracted position of FIG. 1, permits the boom to be stored with the entire length of the retracted boom extending to a height not appreciably more than the height of the cab. As in FIG. 1, a block 9 across each half of the lower assembly L prevents any further downward movement of the upper assembly U.

In accordance with this invention, the basket B, although extending below the boom, is collapsible horizontally, so that it may be stored in a vertical position behind the cab, as in FIG. 1, to extend upwardly no further than the stored boom. Although the basket B, in retracted position, requires more vertical space than if it were folded down onto its floor, as referred to previously in the prior art, there is adequate room behind the cab for the vertical space required. Thus, the horizontally collapsible basket adds materially to the ability of the vehicle on which the boom and horizontally collapsible basket are mounted, to meet the requirements for a vehicle having a boom and basket to occupy a minimum space, for instance, such as not more than 8½ ft. in height, with a body and cab width of 8 ft., actually determined by the wheels W and W', and a length of 30 ft, more or less. Such dimensions permit the vehicle so equipped to be shipped by air, as to a location near a crash site, as well as to be driven expeditiously in heavy traffic and around sharp curves. After unloading at a suitable landing place for the plane carrying a vehicle constructed in accordance with this invention, the vehicle may be driven to the crash site or place where the boom and basket are to be used. With the upper base assembly U and lower base assembly L, as well as the turntable T and cylinder Y and the roller R and arm assembly A being below the boom, at various distances, the center of gravity of the vehicle is lowered sufficiently so that the vehicle may be easily maneuvered, such as around an aircraft, e.g. under wings and tail surfaces, as well as driven safely by virtue of the relatively low center of gravity and four wheel drive, over extremely rough and sloping terrain or around sharp corners of city or country roads without stalling or overturning, as well as with a maximum clearance for overhead branches and the like.

Another advantage of the boom and basket of this invention is that, as the crash site or place of use is approached, the basket may be entered from the cab while the vehicle is still moving. This advantage is provided by the ability of the arm assembly A to be activated to cause the roller R to lift the outer end of the boom to a position higher than the cab, as in FIG. 2, in which roller R has engaged the underside of the boom to lift it to an upper position and the basket unfolded over the rear of the cab, as shown. When preparing for entry to the basket from the cab, as in FIG. 2, a front floor plate 10 of the basket may remain in an upward position, while a rear floor plate 11 may be moved down, as shown by the dotted lines, thus enabling one or more persons to move into the basket from beneath. When the basket is so positioned, a sliding panel S in the roof of cab C may be moved laterally to provide an opening which will permit one or more operators to enter the basket from the cab, as while the vehicle is approaching the crash site. The front half 10 of the bottom of the basket can be shifted to its down position after the basket has been entered by the desired persons. The basket is mounted on a laterally U-shaped bracket K which is pivotally attached to the underside of the outer end of the inside cylinder 12 of boom B by a pin 14, while a leveling cylinder 15 may be utilized to maintain the basket in a horizontal position normally parallel to the top of the cab and the truck frame. The bracket K carries a normally upright pin 16 which permits the basket B to be pivoted from side to side, such as 45° to either side by a yaw cylinder 17.

Figure 3:
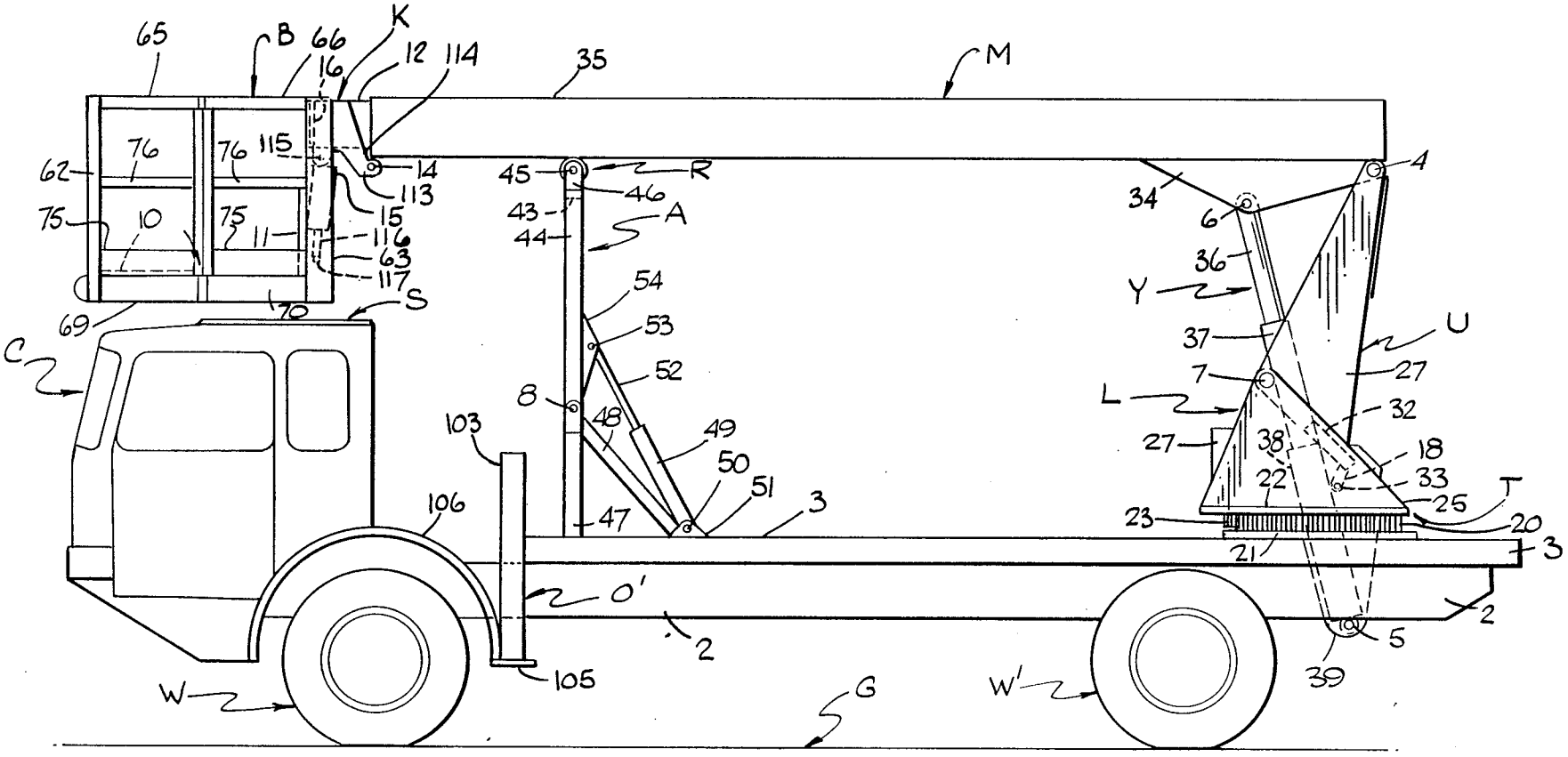
FIG. 3 is a side elevation corresponding to FIG. 2 but showing the result of moving the boom upwardly and forwardly, with the basket over the cab of the vehicle to also permit entry the basket from the cab.

After the vehicle is positioned at the site, the upper base assembly U for the boom may then be lifted upwardly by cylinder Y until it reaches the position of FIG. 3 at which pivot pin 4 of the boom will have moved upwardly and forwardly placing the boom and basket in the operating position. Spring loaded latches 18 of FIG. 3 will then have locked upper base U to lower base L. Since the boom and basket will be entirely supported by cylinder Y and bases U and L, the roller support assembly A can then be removed to its horizontal position while at the same time the rear and front outriggers 0 and 0' may be positioned on the ground for stability. The boom and basket movements may then be controlled from either the cab or the basket.

Figure 5:
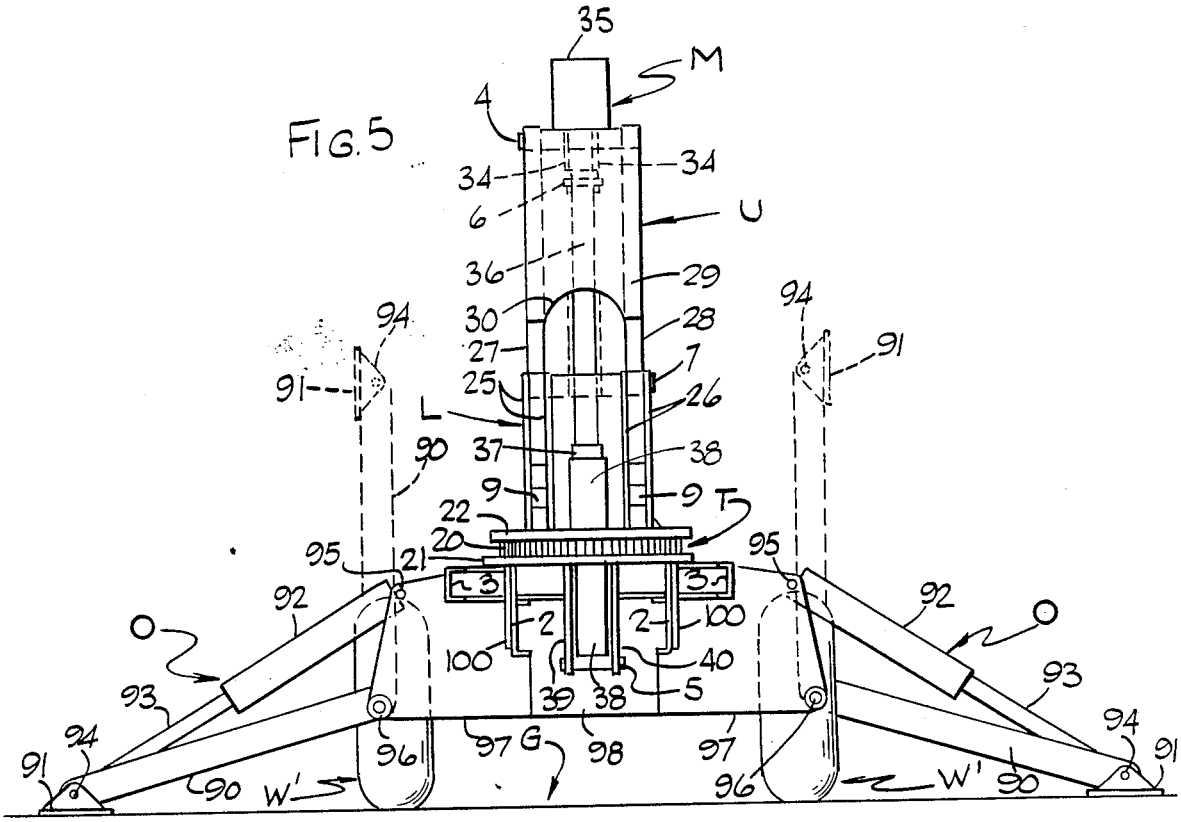
FIG. 5 is a rear view of the vehicle, boom and basket and associated parts as shown in FIG. 3.

In FIGS. 1 and 5, the turntable T includes a ring gear 20 which is bolted to a ring plate 21, in turn welded to the sub-frame beams 8. On its inside, ring gear 20 forms the outer race of a ball thrust bearing constructed in accordance with the 1988 catalog of Gear Products, Inc., of Tulsa, Okla., thereby having a ring shaped inner race. A ring plate 22 of lower base assembly L is bolted to the inner race of the ball thrust bearing, while the turntable T and lower base assembly L are rotated in a desired direction by a pinion 23 which engages ring gear 20 and, in turn, is driven by a reversible motor 24. The lower base assembly L includes two pairs of triangular plates 25 and 26 which are attached in upright spaced position, as by welding, to plate 22, as in FIGS. 1, 3 and 6. The upper base assembly U includes spaced triangular plates 27 and 28, with a reinforcing plate 29 attached to the rear edges of plates 27 and 28 for a substantial distance from the top down, plate 29 having a concave lower edge 30 for a purpose referred to later. Plates 27 and 28 of upper base assembly U move between the respective pairs of plates 25, 25 and 26, 26 of the lower assembly L, while the obtuse angles of the respective plates are each pivoted on pin 7, which is mounted on the outer ends of pairs of plates 25 and 26. Pivot pin 9 for boom M extends between the opposite ends of plates 27 and 28. A stop block 32 is attached to the lower corner of plate 27, as in FIG. 1, and a similar stop block is similarly attached to plate 28, each to engage the latch 18. To hold the plates in a boom operating position, latch 18 of FIG. 3 is pivoted on a pin 33 extending between plates 25 and a similar latch is pivoted between plates 26, to securely hold plates 27 and 28 in an upper position for stability during movement of boom M. These latches 18 may be spring actuated to swing into position to engage the block 32 at the lower corner of plate 27 or 28 when the plates reach the position of FIG. 3 and may be hydraulically pivoted rearwardly to permit the plates 27 and 28 to return to the position of FIG. 1.

For upward and downward movement of the boom M, a pair of triangular plates 34 are attached to the underside of an outer cylinder 35 of the outer boom, forward from its rear end, as in FIGS. 1 and 3, with pivot pin 6 extending between the mid points of the plates, as in FIG. 3. Pin 6 pivotally connects with the outer end of a rod 36 of the multi-stage cylinder Y, which may include an intermediate cylinder 37 and a lower cylinder 38. The lower end of cylinder 38 is mounted on pivot pin 5, extending between the lower ends of a pair of plates 39 and 40 of FIGS. 1 and 5, which depend from and are attached to the underside of plate 22. As will be evident, cylinder Y extends downwardly from plates 34, not only between plates 27 and 28 of upper assembly U and between plates 25 and 26 of lower assembly L, but also through plate 22 and the rotatable ring within ring gear 20. Thus, the purpose of the concave lower edge 30 of reinforcing plate 29 is to provide clearance for cylinder Y as the upper assembly U moves between the positions of FIG. 1 and FIG. 3.

As will be evident, when cylinder Y first thrusts upwardly from the position of FIG. 1, the upper assembly U, including plates 27 and 28, will move with it, being lifted by pivot pin 6. When the upper assembly A reaches the position of FIG. 3 and the blocks on upper plates 27 and 28 are caught by latches 18, further upward movement produced by cylinder Y will cause boom M to pivot about pin 4. Of course, as the cylinder Y extends, the angularity of the boom becomes greater and greater. Thus the boom may be extended such that the lower edge of the basket will reach a height of over 70 ft. above the ground with the boom at an angle of 75° from the horizontal. The turntable T may also be swung to any position of a 360° circle.

Figure 6:
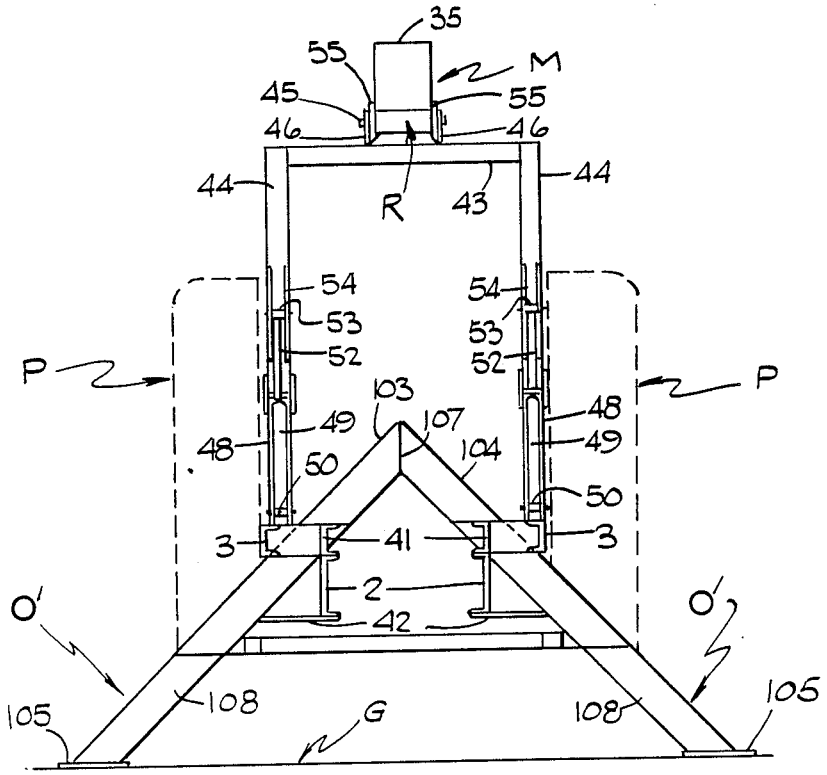
FIG. 6 is a rear view of certain parts shown in FIG. 3, taken from the position of line 6—6 of FIG. 3.

The arm assembly A is mounted on a box shaped structure 41 of FIG. 6 extending laterally outwardly from one beam 3 and a box shaped structure 42 extending in the opposite direction from the opposite beam 3. Roller R is mounted on a beam 43 which extends between a pair of pivoted arms 44, as in FIG. 6, and each of which is moved about a pivot 8 of FIG. 1, between the horizontal position of FIG. 1 and the upright position of FIGS. 2, 3 and 6. Roller R turns about a shaft 45 which is supported by upright brackets 46 mounted atop beam 43, as in FIG. 6. Each arm 44 is pivoted on a pin 8 at the upper end of an upright standard 47, so as to be movable between the position of FIG. 1 and the position of FIGS. 2, 3 and 6, while each standard 47 is reinforced by a strut 48, angled downwardly for attachment to box shaped structure 41 and 42, as are also standards 47. Each arm 44 is moved by a cylinder 49 whose lower end extends to a pivot 50 extending between the sides of a dual bracket 51, while rod 52 of each cylinder 49 extends to a pivot 53 between the sides of a dual bracket 54 which is mounted on the rear of the corresponding arm 44 adjacent the lower end of the latter. Roller R may also be provided with flared edges 55, as in FIGS. 6 and 7, positioned on each side of the boom to assist in maintaining the roller in engagement with the boom. When arm assembly A moves the boom M upwardly, roller R rolls along the cylinder as it moves it up. When the upper base assembly U moves the inner end of boom M upwardly and therefore also forwardly, roller R may at times stay in the same longitudinal position, move along the boom, or the boom may move along the roller, thereby rotating it.

After the workmen have moved into the basket from the cab, they may also move tools or equipment with them which they might anticipate using. There may, of course, be occasions when the overhead clearance is such that raising the basket and cylinder to the position of FIG. 2 or FIG. 3, for instance, would be inadvisable. However, considerable time can usually be saved by erecting the basket and transferring the necessary personnel to the basket, while still driving to the scene of use of the equipment.

Figure 4:
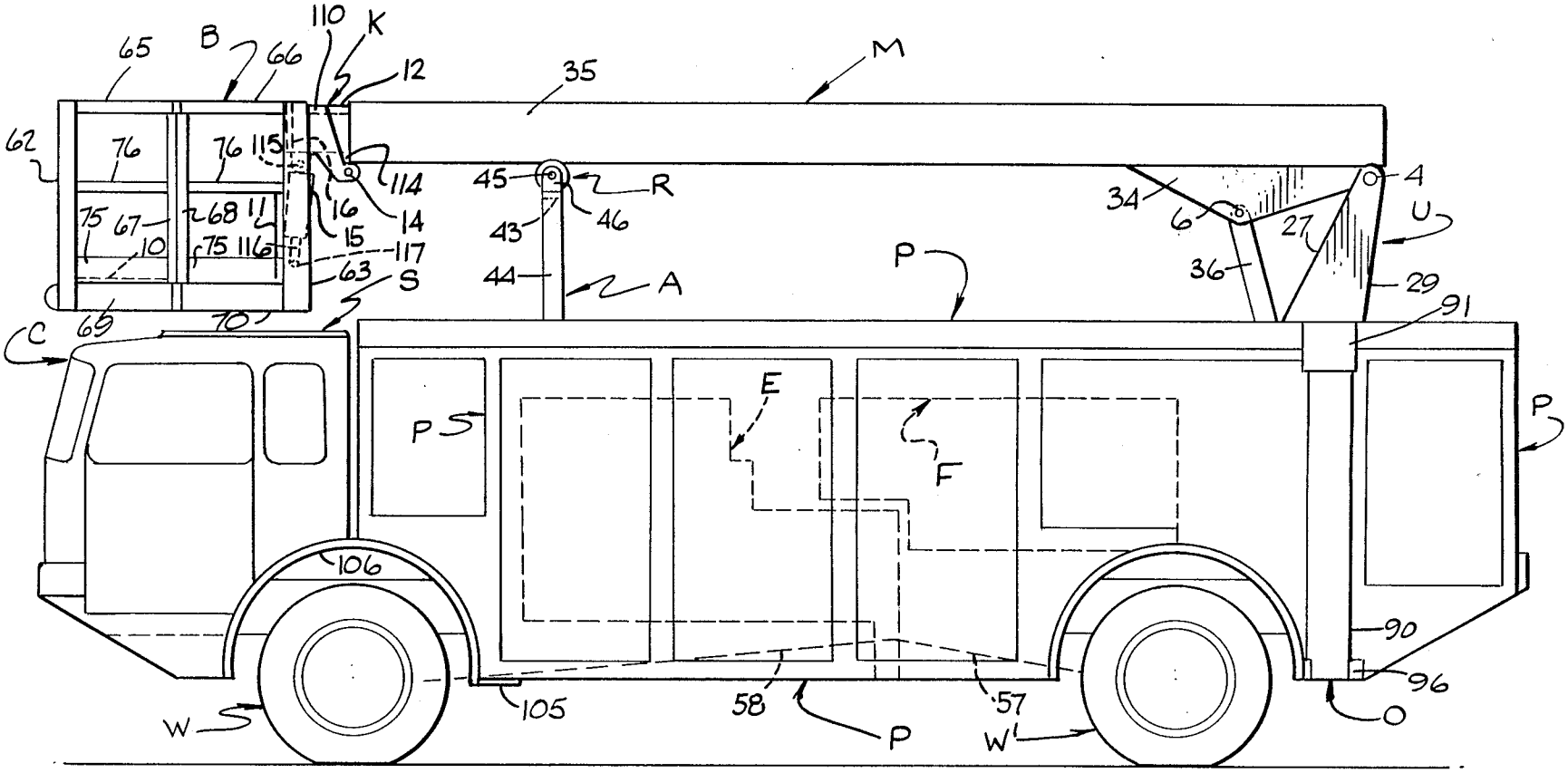
FIG. 4 is a side elevation of the vehicle, showing representative panels and compartments on the outside of the vehicle, with the boom and basket in the position of FIG. 3.

In FIG. 4, the vehicle is shown after the basket has been raised to the position of FIG. 3, either just as the persons to occupy the basket have started to move or have moved into the basket from the cab, such persons not being shown in the view. Each side of the vehicle will be similar to the side shown, with a series of panelized compartments P, having at each side the height and length shown, with the width in dotted lines indicated in FIG. 6. These compartments may be utilized for storage of supplies, materials or the like. In space not occupied by the boom M or its operating parts or the basket B and between the panelized compartments P on each side as shown in FIG. 4, is a space E, shown in dotted lines, in which the engine is located, with a dotted line 57 indicating the centerline for the drive to the rear wheels and a dotted line 58 indicating the centerline of the drive to the front wheels. It is noted that the arm assembly A, which carries the roller R, straddles the engine space E, while the panelized compartments P are outside the arm assembly A, as in FIG. 6. A space F, also shown by dotted lines, is provided for storage of fuel, water and halon or other liquid materials. As in FIG. 4, a rear outrigger 0 is stored in upright position rearwardly of the rear wheel on each side, while a front outrigger 0' is retracted on each side rearwardly of the front wheels.

Figure 8:
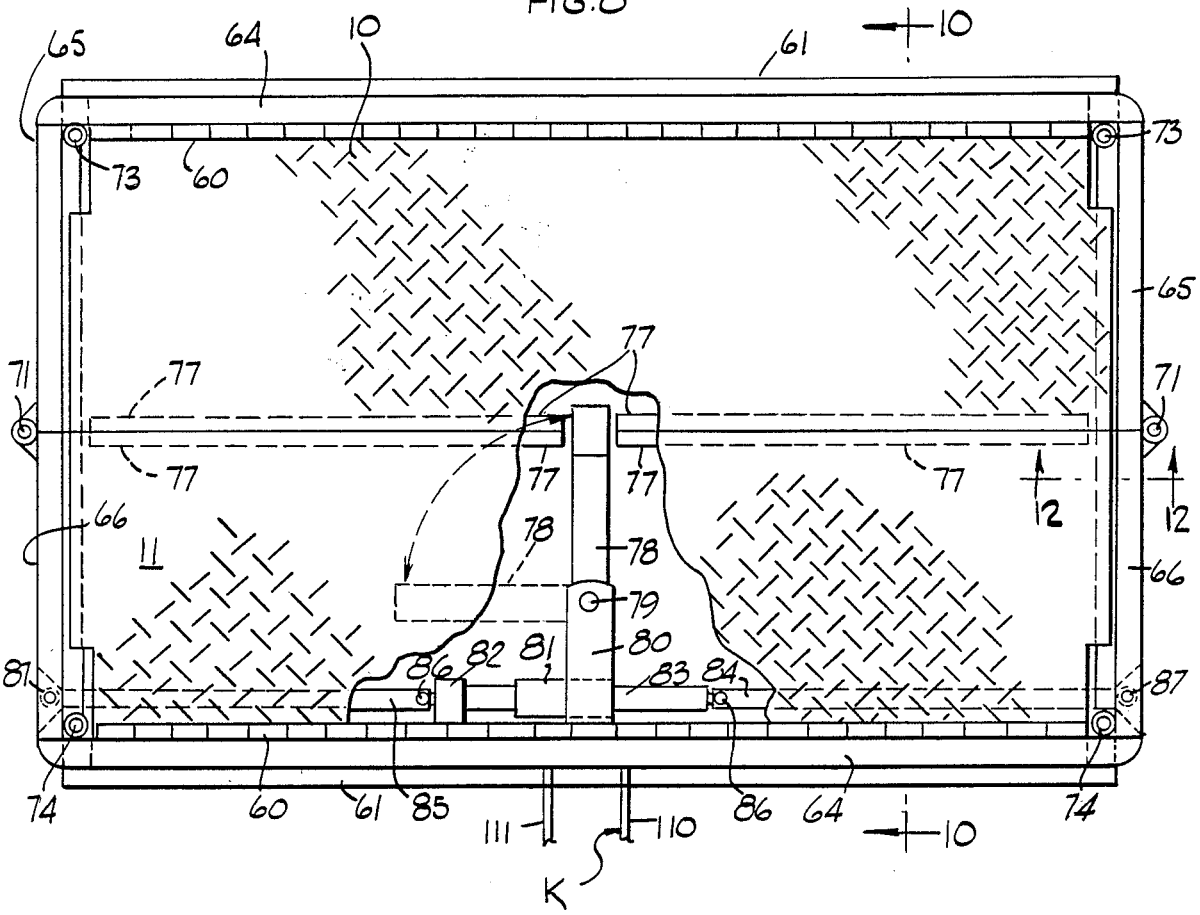
FIG. 8 is a top plan view of the basket in working position.
Figure 9:
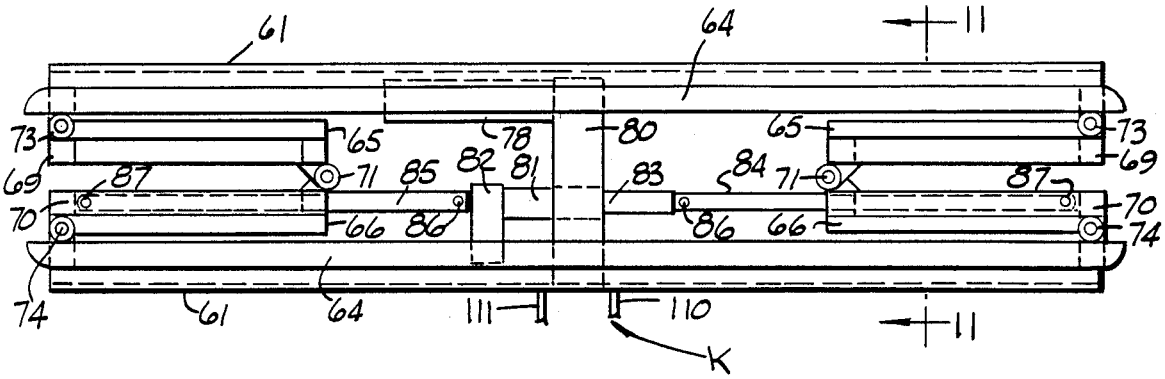
FIG. 9 is a top plan view of the basket in folded or storing position.
Figure 10:
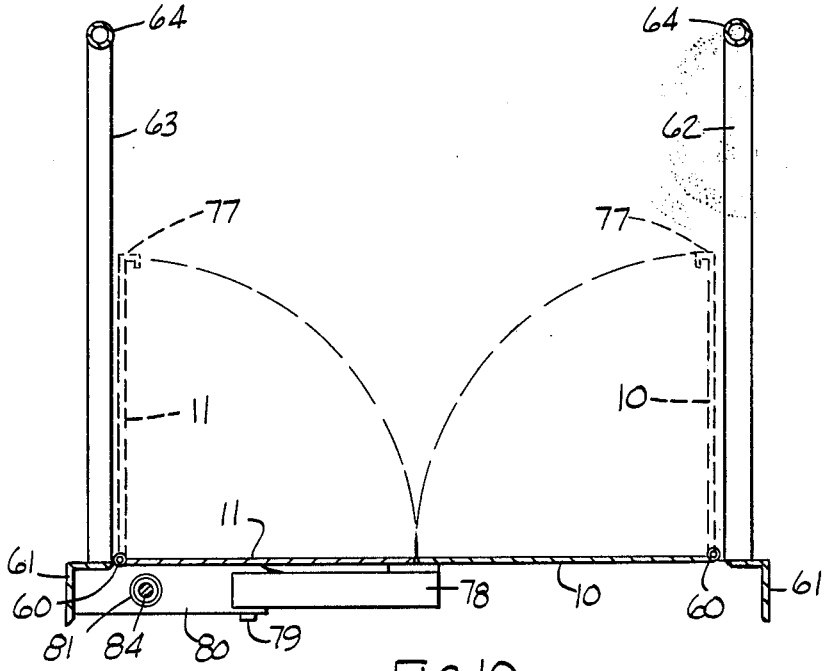
FIG. 10 is a transverse vertical section, taken along lines 10—10 of FIG. 8.
Figure 11:
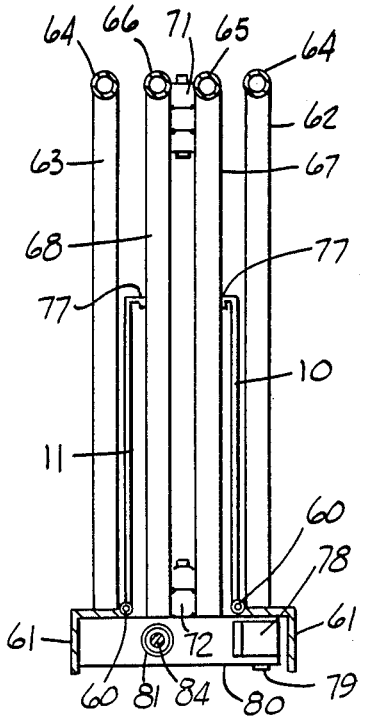
FIG. 11 is a transverse vertical section, taken along line 11—11 of FIG. 9.
Figure 12:
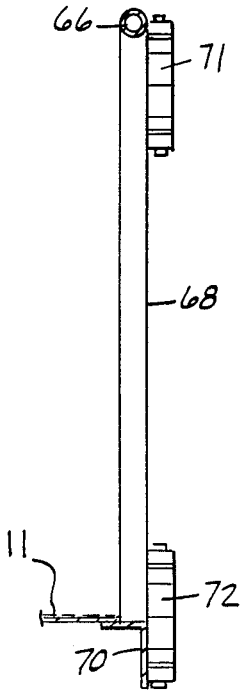
FIG. 12 is a fragmentary vertical section, taken along line 12—12 of FIG. 8.

In addition to the floor plates 10 and 11, the basket B includes, as in FIG. 8, a hinge 60 for each of the floor plates 10 and 11 with each hinge being attached to the inside lip, as in FIGS. 10 and 11, of a bottom angle 61 at front and rear. As in FIG. 3, a post 62 extends upwardly at each front corner and a post 63 at each rear corner, these posts being mounted on angles 61 with corresponding posts at opposite corners, while a top rail 64 of FIGS. 8 and 9 extends between the top of each pair of posts 62 and 63 above an angle 61. Each side of the basket is hinged, not only at the center but also at each corner, so that the sides will pivot inwardly to the folded position of FIGS. 9 and 11. Thus, each side is provided with a pair of top rails 65 and 66, as in FIGS. 2, 3 and 8, while a pair of center posts 67 and 68, as in FIGS. 2 and 3, connect at the top to the respective rail 65 or 66 and at the bottom to an angle 69 or 70, as in FIGS. 8 and 12. Thus, adjoining posts 67 and 68 are connected at the top by a hinge 71 and at the bottom by a hinge 72 of FIG. 12, with the opposite end of a top rail 65 being pivotally connected to the front top rail 64 by a hinge 73 and a top rail 66 at each side being connected to a rear top rail 64 by a hinge 74 of FIG. 9. Similarly, the base of each folding side of the basket is provided with hinges similar to hinges 73 and 74 for connecting the outer ends of lower angles 69 and 70 of FIG. 2 to side angles 61. Each side of the basket also includes a kick plate 75, just above floor plates 10 and 11, to prevent tools or other objects being expelled from the basket as by kicking to fall on a workmen below. The kick plates 75, respectively, extend between post 62 and post 67 and between post 63 and 68, but are pivoted on posts 62 and 63. Similar kick plates on the other side of the basket occupy similar positions. Also, each end of the basket has a single kick plate, similarly mounted just above the floor plates. Each side of the basket is further provided with a pair of central reinforcing bars 76, each of which extend between posts 62 and 67 and between posts 63 and 68, respectively, with the opposite side of the basket being similarly equipped, while bars similar to bars 76 extend in a similar position between corner posts 62 at the front and corner posts 63 at the rear, below top rails 64, although these bars need not be pivoted to a post. Each floor plate 10 and 11 is provided with a depending flange 77 for reinforcement purposes, but these flanges terminate adjacent the center, so that the floor plates 10 and 11, when in down position, as in FIG. 10, will engage the top of a block 78, to provide additional support to the floor plates when in use. Block 78 is pivotally attached, by a pivot pin 79, to a support block 80, the inner end of which is attached, as by welding, to the flanges of angle 61. When the basket is to be collapsed horizontally to the position of FIG. 9, floor plates 10 and 11 are moved upwardly to the dotted position of FIG. 10 and pivoted block 78 is turned to the dotted position of FIG. 8, so as to be adjacent and parallel to the depending flange of the opposite angle 61, as in FIG. 11. Support block 80 not only assists in supporting floor plates 10 and 11 when block 78 is extended, but also conveniently carries a mechanism for collapsing the basket horizontally, as well as unfolding it. Thus, an annular sleeve 81, which extends through block 80 and also through an additional support block 82, carries a cylinder 83, from opposite ends of which piston rods 84 and 85 extend. Rods 84 and 85 have a pivot connection 86 and 87, respectively at their inner and outer ends, the latter at the respective bottom angle 70 of FIGS. 2 and 3. Pivot connections 87 conveniently depend from the top flange of the angle 70, at a position relatively close to the pivot directly below the hinge 75, as in FIG. 9. With the basket in the operating position and as shown in FIG. 8, the floor plates 10 and 11 are first pushed upwardly to the dotted position of FIG. 10. When the rods 84 and 85 are retracted, the half of each side of the basket below top rail 66, pulled on by a rod 84 or 85 will be moved inwardly, pivoting about hinges 75 and the corresponding hinges below them. This movement will cause the halves of the sides below top rails 65 also to start moving inwardly, with pivoting about hinges 71 and 72 of FIG. 12, as well as about hinges 74 of FIG. 8 and the hinges below them. Of course, inward movement of either half of a side below a top rail 66, or below a top rail 65, or both, will cause the front end of the basket to be pulled toward the rear end. When the position of the parts of the basket reach that shown in FIGS. 9 and 11, the basket is in collapsed position and ready to be stored. The collapsed position of the basket can provide a substantial decrease in the space occupied by the basket, such as diminishing the length of the basket from 55 inches to 17 inches, or to less than one third. Before collapsing the basket, it is desirable to retract the boom fully, after placing it in the position of FIGS. 3 and 4, with the boom supported by roller R and arm assembly A, but the occupants of the basket should be unloaded into the cab before starting to collapse the basket. Then, the basket may be collapsed with the inner end of the boom lowered to the position of FIG. 2. Then, the outer end of the boom and basket can be lowered by retracting arm A and roller R to the original stowed position as in FIG. 1.

Figure 2:
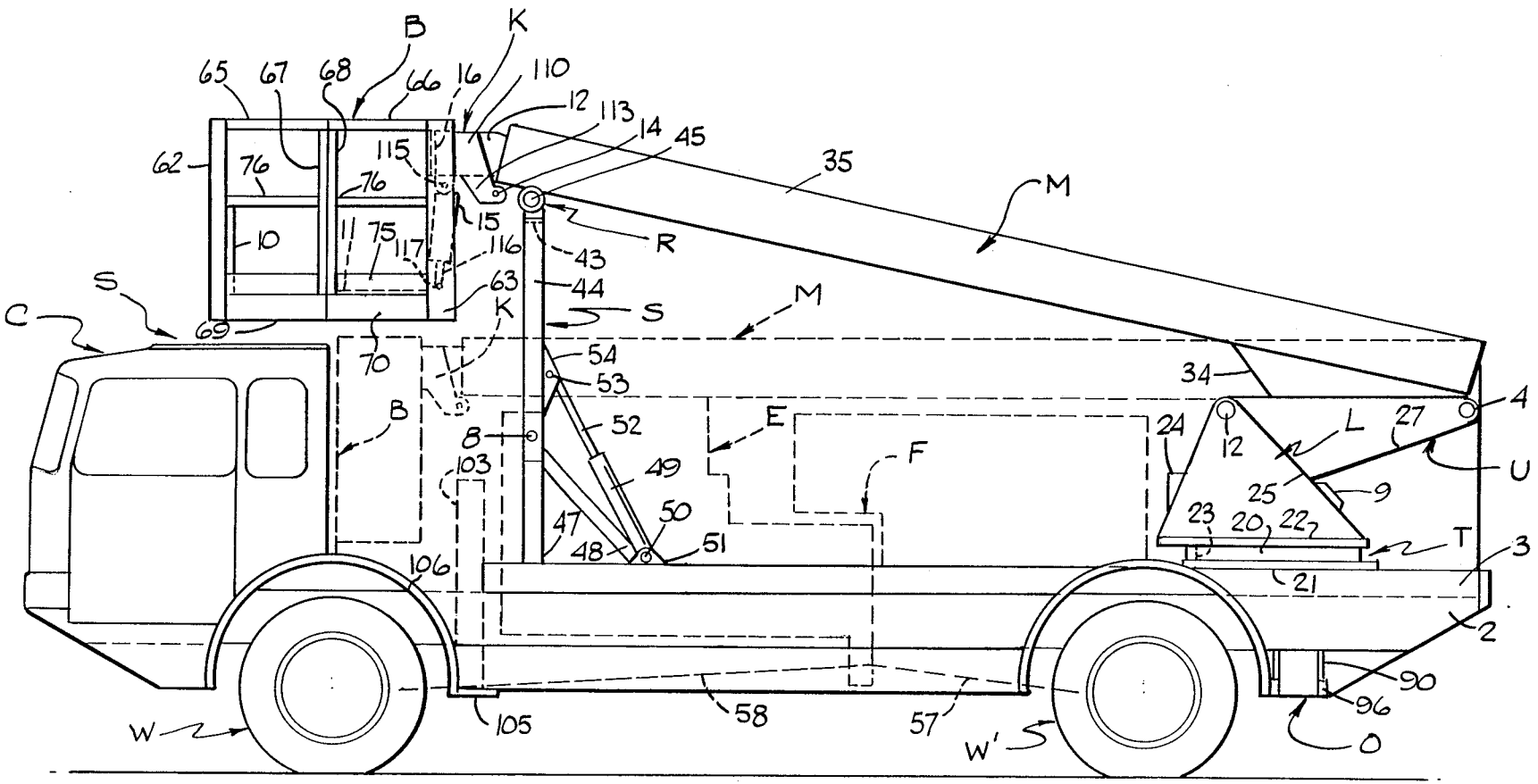
FIG. 2 is a view similar to FIG. 1, but showing the boom as having had its front end only raised and the basket unfolded to extend over the rear portion of the cab to permit entry from the cab.
Figure 7:
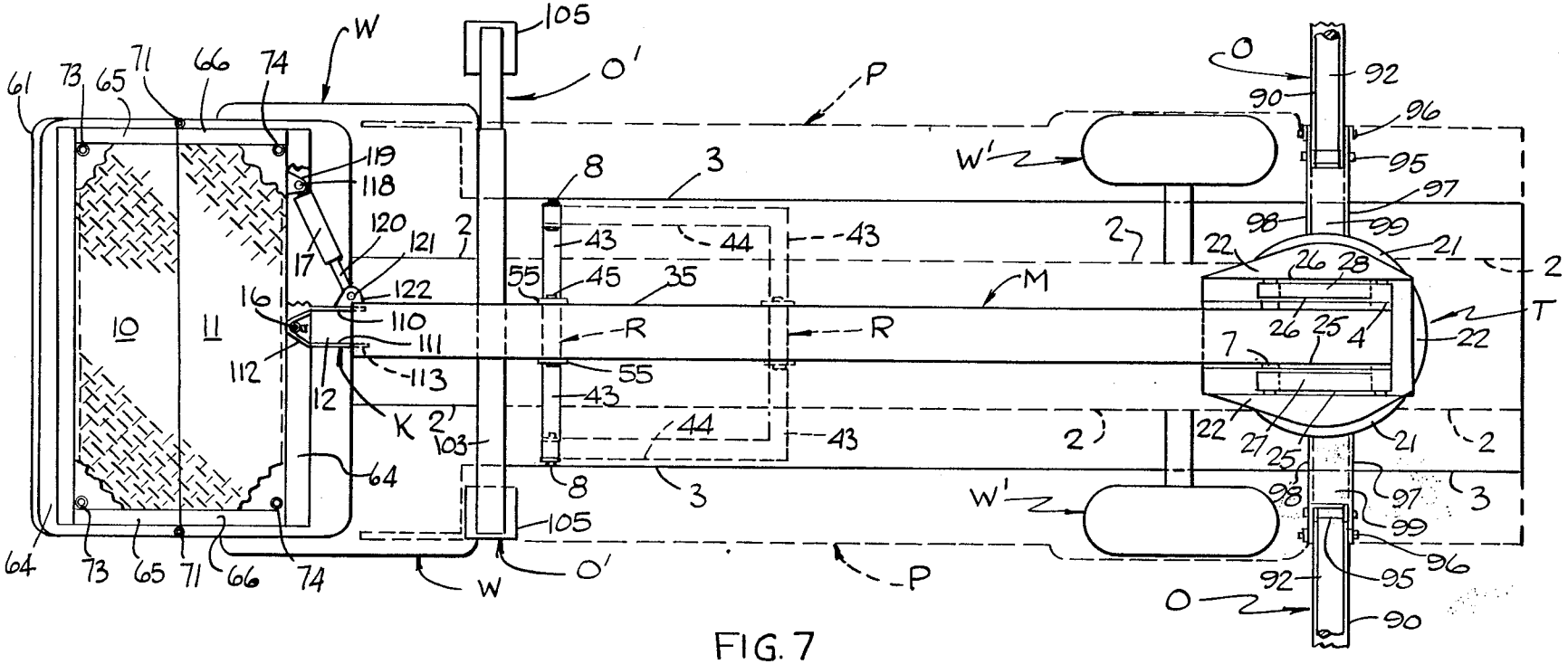
FIG. 7 is a top plan view of the boom, basket and vehicle parts, as shown in FIG. 3, but with the basket further over the cab.

As indicated previously, prior to reaching a point of use, the outer end of the boom may be raised by the roller R and arm assembly A, as to the position of FIG. 2, or the rear end of the boom may also be raised, as to the position of FIG. 3, then the basket unfolded by activating the controls for a cylinder 83 of FIG. 9, shown also in dotted lines in FIG. 7. With the boom over the rear or the front of cab C, the sliding panel S may be moved laterally so that designated occupants of the cab may enter the basket, after one of the floor plates 10 or 11 is placed down. After the basket is occupied, any tools or materials desired may be handed up to the occupants of the basket from the cab, after which the floor plate 10 or 11, which has been up, may be put down. As soon as the place of use of the vehicle is reached, or sometimes even before, the elevation of the boom may begin, so that as little time as possible is wasted in reaching the ultimate point of use.

When the place of use of the boom and basket are reached, each rear outrigger 0 may be extended, with the front outriggers 0' also extended. The rear outriggers 0 are on opposite sides of the vehicle, occupying a storage space within the panels P, as in FIG. 4. In storage position, shown also in dotted lines in FIG. 5, the parts visible prior to extension are a pivoted beam 90 carrying a ground engaging pad 91 adapted to engage the ground G, as in FIG. 5, but carried at the upper end of the beam 90 in storage position. Each rear outrigger also includes a cylinder 92 having a rod 93 which is pivoted to pad 91 and beam 90 by a pin 94. The inner end of cylinder 92 is pivoted on a pin 95, while the inner end of beam 90 is pivoted on a pin 96, with pins 95 and 96 supported by a lateral, beam like pair of spaced, transverse, upright plates 97 and 98, which are reinforced by a plate 99 across the top, as in FIG. 7, and are attached to a mounting plate 100 of FIG. 5, in turn attached to the side of both the vehicle frame 2 and the beams 3. One of the transverse plates, i.e. rear plate 97, may extend only to just inwardly of frame 2, to avoid plates 39 and 40 for supporting pin S for cylinder Y, but the front plate 98 may extend between the frame 2 and beams 3. Both outriggers 0 have a similar construction, with the parts placed in a complementary position and mounted on plates 97 and 98, but on opposite sides of the vehicle. When the cylinders 92 are activated, each rod 3 will move beam 90 down until pad 91 engages the ground G, as shown.

The front outriggers 0', which are spaced from the parts supporting the boom, need not extend outwardly as far as the rear outriggers, although they are quite helpful in stabilizing the vehicle and boom when the boom extends in an angularly forward direction. The front outriggers, as in FIG. 6, are stored in the vehicle, with only the end of a cylinder 103 or 104 and a pad 105 exposed in storage position, in which an exposed pad 105 is horizontal and touches the underside of the rear edge of a fender 106 of the vehicle, as in FIG. 1. The cylinders 103 and 104, as in FIGS. 6 and 7, are mounted in diverging angular positions, such as with each at 45°, but sloping in opposite directions, with the two cylinders being attached, as by welding, at the common upper end 107. As in FIG. 6, the cylinders 103 and 104 are installed forwardly of beams 8, but on vehicle frame 7. As also evident from FIG. 6, the lower edge of a cylinder 103 and 104 is essentially at the lower edge of paneling P. A rod 108 of each front outrigger carries a pad 105 at its lower end and, when extended from the respective cylinder 103 or 104, will cause the pad 105 to engage the ground G, not always as level as shown.

As indicated previously, the bracket K is laterally U-shaped having sides 110 and 111 which fit against the sides of the outer end of inner cylinder 12 of boom B, as in FIGS. 2, 3 and 4, with an angular front end 112 which provides space for upright pin 16 about which the basket B pivots when actuated by yaw cylinder 17. Horizontal pin 14, about which basket B pivots when activated by leveling cylinder 15, extends through a lower ear 113 on each side of bracket K to accommodate pin 14, which also extends through a depending block 114 of FIG. 4, which may be formed as an integral part of cylinder 12 or securely attached thereto. The upper end of leveling cylinder 15 is pivotally connected to the underside of the outer end of boom cylinder 12 at a pivot 115 of FIG. 2, while the lower end of its rod 116, extending from cylinder 12, is connected at pivot 117 to an upright post in the rear wall of basket B in a fixed position, but otherwise corresponding to center posts 67 and 68 of the end walls. The lower end of yaw cylinder 17 is connected by a pivot 118 of FIG. 7 to an ear 119 attached to bottom angle 61 at the rear. The upper end of rod 120 for cylinder 17 is attached by a pivot 121 to an ear 122 which extends laterally from the lower edge of side 110 of bracket K. As will be evident, extension of rod 120 of cylinder 17 will cause basket B to pivot to the left, as perceived by someone in the basket facing forwardly, while retraction of rod 120 will cause basket B to pivot to the right. Similarly, extension of rod 116 of cylinder 15 of FIG. 3 will cause the front of basket B to tip upwardly, while retraction of rod 116 will cause the front of basket B to tip downwardly.

Figure 13:
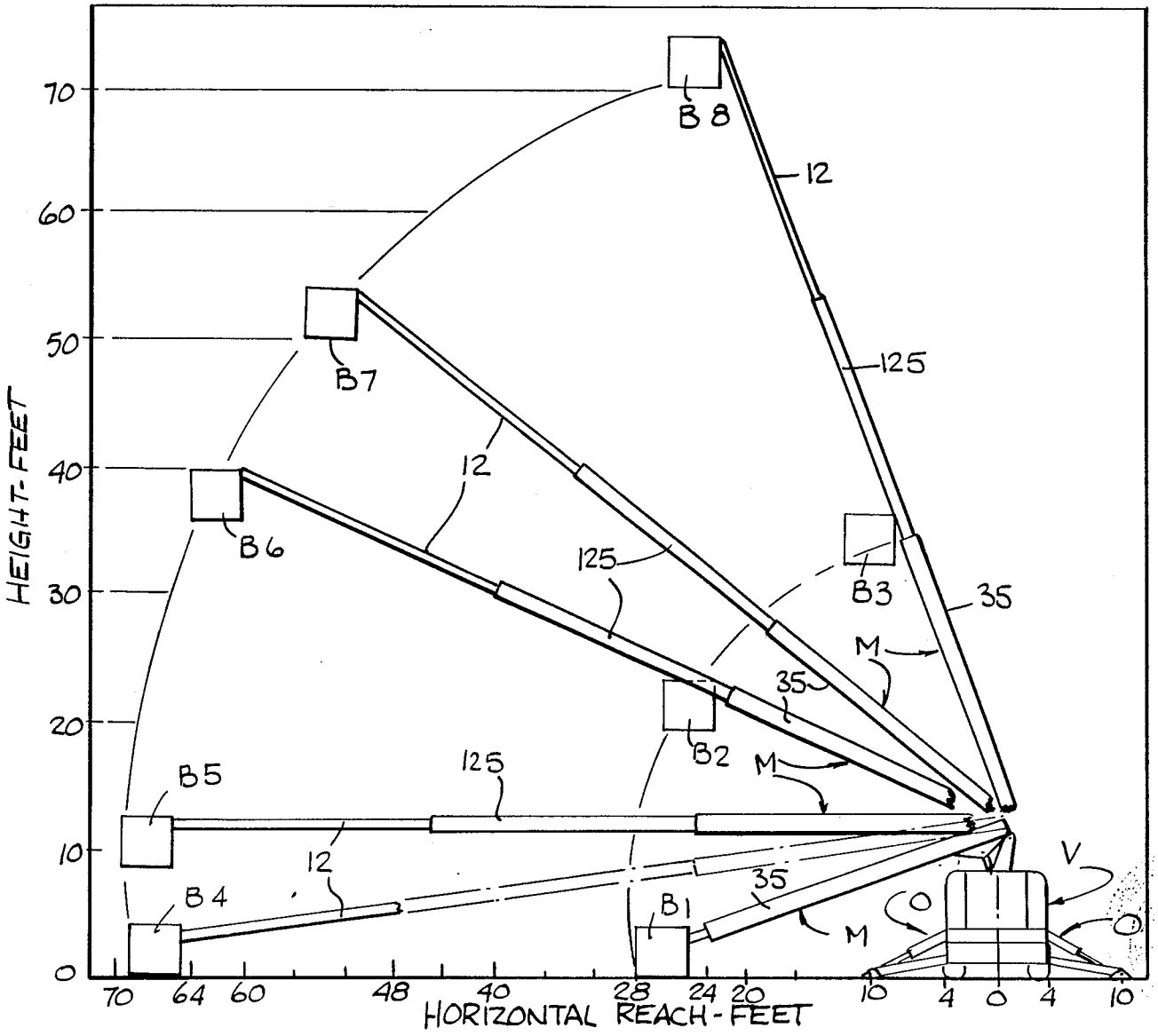
FIG. 13 is a typical chart showing the reach and height capabilities of the boom, as shown by the position of the basket at various upward, angular positions of the boom. Such charts will vary, depending on design requirements.

The chart of FIG. 13 shows the various positions and heights which the lower inner corner of the basket may reach, to one side of the vehicle, with the boom at representative angles, as well as for a slight extension and full extension of the boom, each with the upper base assembly U in the upright position of FIG. 3. For basket positions B1, B2 and B3, the boom M is not extended further than the position of FIG. 7, with outer cylinder 35 swung around to one side. Thus, for boom position B1, the lower inner edge of the basket may be placed on the ground at 25 ft from the centerline of the vehicle, at the zero position on the bottom scale. For such limited extension of the boom, the lower inner edge of the basket, at position B2, may be placed at 20 ft from the ground for an inclination of the boom of 25° to the horizontal. Similarly, at basket position B3, the basket lower corner is 34 ft. from the ground at a boom inclination of 75° to the horizontal. The remaining positions of the basket are shown with the telescoping inner cylinders 12 and 125 extended from outer cylinder 35 to their fullest. Thus, with such extensions of the boom, at positions B5 and B6, the basket may be placed on the ground or at a level with the boom pivot, with the inner edge of the basket 65 ft. and 66 ft., respectively, from the center of the vehicle. In each of the remaining basket positions shown, the elevation of the boom from the ground is more important. Thus, at position B7, the lower inner edge of the basket is at a height of 30.5 ft. from the ground with the boom raised to an inclination of 25° to the horizontal. For position B8, the lower inner edge of the basket is a few inches less than 50 ft. from the ground, with the boom raised to an inclination of 40° to the horizontal. For position B9, the lower inner edge of the basket is 70 ft. above the ground, for a boom inclination of 75° to the horizontal. As will be evident, for a vehicle and its stored boom and basket having a height of 8½ ft. from the ground with the boom and basket in storage position, the heights which can be reached by the basket are quite satisfactory. It will be noted that, for city and country roads, where the clearance for a vehicle is usually considerably in excess of 8½ ft., a folded auxiliary ladder, which can be extended to be 100 ft. long, can be mounted on the folded boom and basket to be carried to a site of use.

Although a specific embodiment of a collapsible boom, a collapsible basket and a vehicle cab have been illustrated and described herein, it will be understood that other embodiments of this invention may exist and various changes may be made therein, all without departing from the spirit and scope of this invention.

What is claimed is:

1. A boom and a basket for a rescue, crash or service vehicle, comprising:

an extendable, elevatable and rotatable boom for mounting on a vehicle, said boom being movable to a retracted and lowered position disposed longitudinally along the upper portion of said vehicle; and a basket mounted on the outer end of said boom and longitudinally collapsible, whereby said basket may be stored at the outer end of said boom to occupy a substantially lesser amount of longitudinal space.

2. A vehicle having a boom and basket, as defined in claim 1, wherein:

said vehicle has a predetermined length, width and height to enable said vehicle to be transported by air.

3. A vehicle having a boom and basket, as defined in claim 1, wherein:

said vehicle is provided with a cab; and said basket is longitudinally collapsible and is adapted to be stored in collapsed position adjacent said cab.

4. A vehicle having a boom and basket, as defined in claim 1, wherein:

said vehicle has a cab disposed adjacent the front of said vehicle and providing an enclosure for a plurality of persons and from which functions of said vehicle and boom and basket may be controlled; and said cab and said basket are provided with means permitting one or more persons to enter said basket from said cab with said basket in erected position above at least a portion of said cab.

5. A vehicle having a boom and basket, as defined in claim 4, wherein:

said basket is provided with sides connecting the back and front, each side being pivotally attached to the back and front; and each side being pivotal along its center.

6. A vehicle having a boom and basket, as defined in claim 4, wherein:

said basket is provided with two floor members, one being pivotal upwardly from the lower front of said basket and the other being pivotal upwardly from the lower rear of said basket.

7. A vehicle having a boom and basket, as defined in claim 4, including:

means for raising the basket end of said boom, so as to raise said collapsed basket to a position in which said basket may be erected to extend to a position above at least a portion of said cab.

8. A vehicle having a boom and basket, as defined in claim 7, including:

means disposed adjacent the rear of said vehicle for pivotally supporting the inner end of said boom.

9. A vehicle having a boom and basket, as defined in claim 8, including:

turntable means on which is mounted said means for pivotally supporting the inner end of said boom.

10. A vehicle having a boom and basket, as defined in claim 8, including:

means for elevating said means for pivotally supporting the inner end of said boom, whereby said inner end and outer end of said boom may be elevated to a generally corresponding height for positioning said basket, upon erection, above said cab.

11. A vehicle having a boom and basket, as defined in claim 7, wherein said means for raising the outer end of said boom comprises:

a roller extending transversely beneath and engageable with said boom;

a laterally extending beam on which said roller is rotatably mounted;

a pair of laterally spaced arms extending angularly upwardly from a portion of said vehicle to a point below said boom in stored position;

a pair of bars, each pivotally mounted on one of said arms and extending to the respective end of said beam; and a pair of hydraulic cylinders, each having its lower end pivotally mounted on said vehicle and an extendable piston rod whose outer end is pivotally connected to one of said bars adjacent said arm.

12. A vehicle having a boom and basket, as defined in claim 1, wherein said boom is pivotally mounted for movement to an upper position above said retracted position and including:

means for supporting said boom in both said retracted position and said upper position, including a lower base assembly and an upper base assembly;

means at a front position of said upper base assembly for pivotally supporting said upper base assembly on said lower base assembly;

means at a rear position of said upper base assembly pivotally supporting the inner end of said boom;

means for producing pivotal movement of said boom upwardly and downwardly;

stop means carried by said lower base assembly for limiting downward pivotal movement of said upper base assembly; and latch means mounted on said lower base assembly for maintaining said upper base assembly in position after a predetermined upward pivotal movement.

13. A rescue, crash or service vehicle, comprising:

a longitudinally extendable boom pivotally mounted on said vehicle;

a cab disposed adjacent the front of said vehicle and providing an enclosure for a plurality of persons and from which functions of said vehicle, boom and basket may be controlled;

a basket mounted on the end of said boom and movable to a position above a portion of said cab; and said basket having a floor member which is pivotal upwardly to provide an opening for permitting one or more persons to move into said basket from said portion of said cab through said opening.

14. A vehicle as defined in claim 13, wherein:

said basket is provided with two floor members, one being pivotal upwardly from the lower front of said basket and the other being pivotal upwardly from the lower rear of said basket.

15. A vehicle, as defined in claim 13 wherein:

the top of said cab is provided with aperture means for providing an opening through which a person may enter said basket from said cab when said basket is sufficiently over said opening.

16. A vehicle as defined in claim 13, wherein:

said basket is longitudinally collapsible for storage behind said cab; and said boom is movable to a storage position disposed longitudinally of said vehicle behind said basket storage position.

17. A vehicle as defined in claim 13, wherein:

said basket is provided with sides connecting the back and front, each side being pivotally attached to the back and front; and each side being pivotal along its center.

18. A service vehicle, comprising:

a wheeled frame;

means for driving said wheels;

means for controlling said vehicle;

a longitudinally extendable boom pivotally mounted on said vehicle for storage in a lower position and for movement to an upper position;

means for supporting said boom in both said lower position and said upper position, including a lower base assembly and an upper base assembly;

means at a front position of said upper base assembly for pivotally supporting said upper base assembly on said lower base assembly;

means at a rear position of said upper base assembly pivotally supporting the inner end of said boom;

means for producing pivotal movement of said boom upwardly and downwardly;

stop means carried by said lower base assembly for limiting downward pivotal movement of said upper base assembly; and latch means mounted on said lower base assembly for maintaining said upper base assembly in position after a predetermined upward pivotal movement.

19. A service vehicle, as defined in claim 18, including:

a longitudinally collapsible basket mounted on the end of said boom and adapted to occupy a minimum of longitudinal space when suspended from said boom with said boom and basket in storage.

* * * * *